United States Patent [19]

Entringer et al.

[11] Patent Number: 5,052,958

[45] Date of Patent: Oct. 1, 1991

[54] MARINE DRIVE WITH EASIER SHIFTING

[75] Inventors: David C. Entringer, Wautoma, Wis.; Edward C. Eick; Paul J. Govek, both of Stillwater, Okla.

[73] Assignee: Brunswick Corporation, Skokie, Ill.

[21] Appl. No.: 407,202

[22] Filed: Sep. 14, 1989

[51] Int. Cl.[5] ..... B63H 21/28

[52] U.S. Cl. ..... 440/75; 440/86; 440/89

[58] Field of Search ..... 440/86, 75, 89, 57, 440/900

[56] References Cited

FOREIGN PATENT DOCUMENTS 185396 10/1983 Japan ..... 440/86

*Primary Examiner*—Sherman Basinger

*Attorney, Agent, or Firm*—Andrus, Sceales, Starke & Sawall

[57] ABSTRACT

A marine drive (10) has a driveshaft housing (20) including a bell housing (22) with an exhaust passage (30) therethrough directing exhaust gas and cooling water, and a shift shaft (34) extending through the exhaust passage and journaled in the bell housing by a bushing (52) in a bore (38) in a section (40) of the bell housing. The interface (50) of the bushing and the bore is subject to corrosion from exhaust gas and cooling water. Shifting is eased by enabling a portion (54) of the bushing to contract radially inwardly toward the shift shaft (34) due to the noted corrosion, without binding the shift shaft and otherwise impeding rotation thereof.

6 Claims, 1 Drawing Sheet

MARINE DRIVE WITH EASIER SHIFTING

BACKGROUND AND SUMMARY

The invention relates to shifting systems for marine drives, and more particularly to method and apparatus facilitating easier shifting.

A marine stern drive has a driveshaft housing including a bell housing with an exhaust passage therethrough directing exhaust gas and cooling water. A shift shaft extends through the exhaust passage and is journaled in the bell housing by a bushing in a bore in a section of the bell housing. It has been found that the interface of the bushing and the bore in the section of the bell housing is subject to corrosion from the exhaust gas and cooling water, and that such corrosion at the noted interface causes the bushing to contract radially inwardly toward the shift shaft and may tend to bind same and hence impede rotation thereof, which in turn makes shifting difficult.

The present invention recognizes, addresses and solves the above noted problem in a particularly simple and effective manner.

DETAILED DESCRIPTION

1. Prior Art

Figure 1:
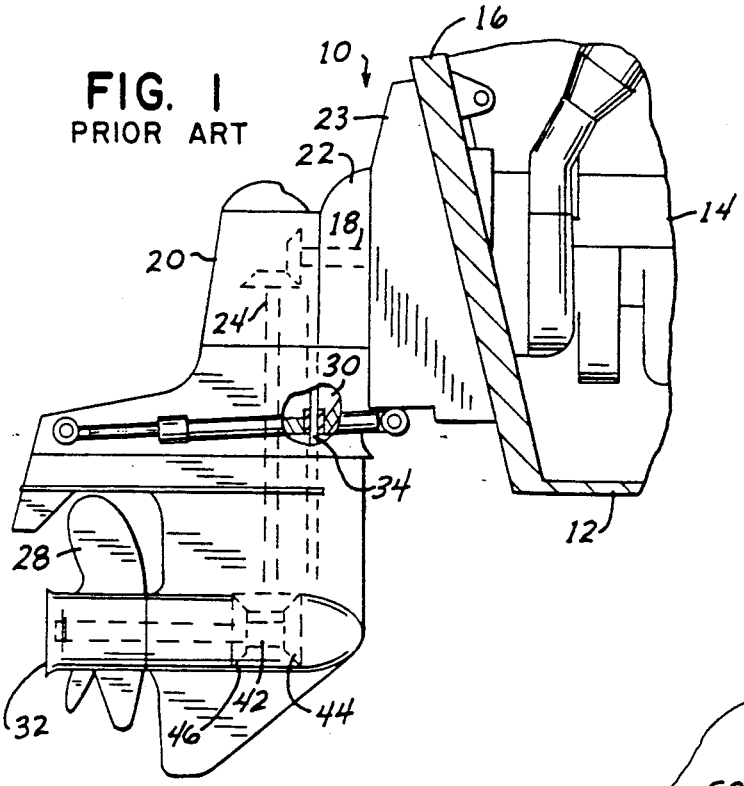
FIG. 1 PRIOR ART
FIG. 1 shows a marine stern drive known in the art, partially cut away.

FIG. 1 shows a marine stern drive 10 including a boat 12 having an engine 14 mounted to transom 16 and driving a horizontal output shaft 18. The marine drive has a driveshaft housing 20 including a bell housing 22 mounted to gimbal ring and housing 23 which is mounted to transom 16 and through which output shaft 18 extends. Vertical driveshaft 24 in driveshaft housing 20 is driven by output shaft 18 and in turn drives propeller shaft 26 to rotate propeller 28 and propel the marine drive. The bell housing has an exhaust passage 30 therethrough directing exhaust gas and cooling water from the engine downwardly through the driveshaft housing and exiting through the hub 32 of the propeller.

Figure 2:
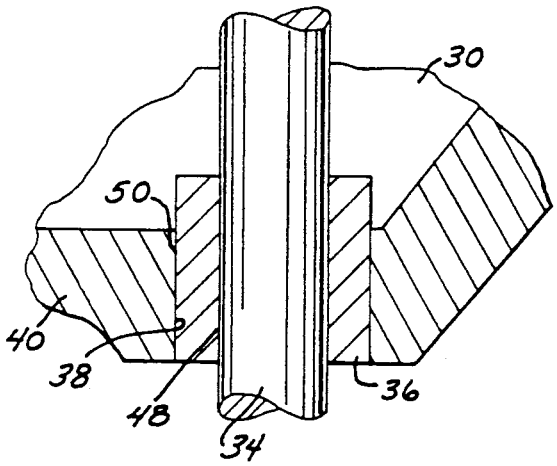
FIG. 2 PRIOR ART
FIG. 2 shows an enlarged section of FIG. 1.
Figure 3:
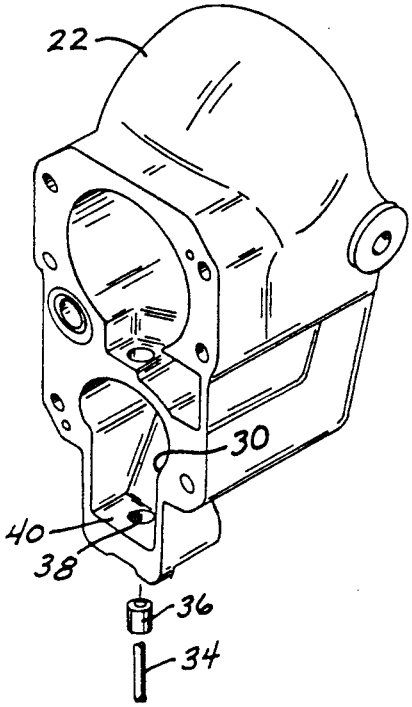
FIG. 3 PRIOR ART
FIG. 3 is a perspective view of part of the structure of FIG. 1.

A vertical shift shaft 34 extends through exhaust passage 30 and is journaled in the bell housing by a bushing 36, FIGS. 2 and 3, in a vertical bore 38 in a horizontal section 40 of the bell housing. Shift shaft 34 is rotated about its vertical axis by upper operator-controlled linkage (not shown) to operate the lower dog clutch 42 between forward and reverse gears 44 and 46, all as is known in the art.

The inner diameter of bushing 36 matches the diameter of shift shaft 34 and provides a bearing surface 48 for shift shaft 34 in bore 38. It has been found that the interface 50 of bushing 36 and bore 38 in section 40 of the bell housing is subject to corrosion from exhaust gas and cooling water, and that such corrosion causes bushing 36 to contract radially inwardly toward shift shaft 34 and may tend to bind the shift shaft and impede rotation thereof. Furthermore, exhaust passage 30 extends across bushing 36 and is defined by a bottom wall which provides the noted section 40 of the bell housing. This bottom wall 40 at bushing 36 is subject to puddling of cooling water in exhaust passage 30, particularly in trimmed out and tilted positions of the marine drive.

2. Present Invention

Figure 4:
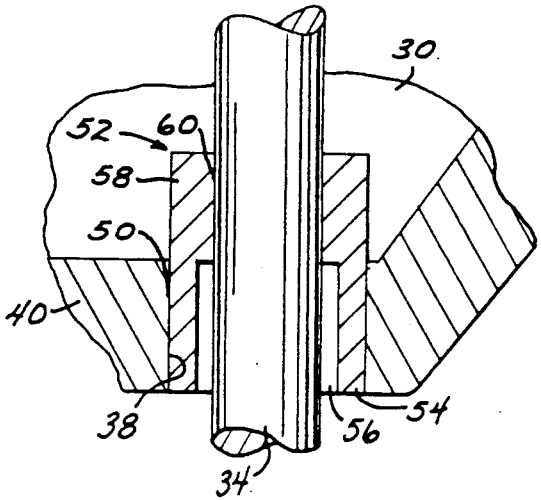
FIG. 4 is like FIG. 2 but shows the present invention.

FIG. 4 shows the present invention and uses like reference numerals from FIG. 2 where appropriate to facilitate understanding. Bushing 52 has a first portion 54 having an outer diameter matching the diameter of bore 38 and received therein. First portion 54 has an inner diameter greater than the diameter of shift shaft 34 and spaced radially outwardly therefrom to define an annular gap 56 therebetween. Bushing 52 has a second portion 58 axially adjacent first portion 54 along the vertical axis of shift shaft 34 and having an inner diameter matching the diameter of shift shaft 34 and forming a bearing surface 60 receiving and supporting shift shaft 34 for rotation therein. Annular gap 56 enables first portion 54 of bushing 52 to contract radially inwardly toward shift shaft 34 due to the noted corrosion at interface 50, without binding shift shaft 34 and otherwise impeding rotation thereof. Second portion 58 of bushing 52 extends upwardly from first portion 54 above bottom wall 40 and into exhaust passage 30. Bearing surface 60 is out of bore 38, and bearing surface 48 is removed.

It is recognized that various equivalents, alternatives and modifications are possible within the scope of the appended claims.

We claim:

1. In a marine drive having a housing with an exhaust passage therethrough directing exhaust gas and cooling water, and a shift shaft extending through said exhaust passage and journaled in said housing by a bushing in a bore in a section of said housing, wherein said shaft rotates in said bushing about the shaft axis and wherein said bushing is non-threadingly mounted in said bore, the interface of said bushing and said bore in said section of said housing being subject to corrosion from said exhaust gas and cooling water, said bushing comprising a first portion having an outer diameter matching the diameter of said bore and received therein, said first portion of said bushing having an inner diameter greater than the diameter of said shift shaft and spaced radially outwardly therefrom to define an annular gap therebetween, said bushing comprising a second portion axially adjacent said first portion along the axis of said shift shaft, said second portion of said bushing having an inner diameter matching the diameter of said shift shaft and receiving and supporting said shift shaft for rotation therein, said annular gap enabling said first portion of said bushing to contract radially inwardly toward said shift shaft due to said corrosion at said interface, without binding said shift shaft and otherwise impeding rotation thereof, and wherein the interface of said second portion of said bushing and said shift shaft is exposed to said exhaust gas and cooling water in said exhaust passage.

2. The invention according to claim 1 wherein said exhaust passage has a section extending across said bushing and defined by a bottom wall which provides said section of said housing having said bore, said bottom wall at said bushing being subject to puddling of said cooling water in said exhaust passage, particularly in trimmed out and tilted positions of said marine drive, and wherein said second portion of said bushing extends upwardly from said first portion.

3. The invention according to claim 2 wherein said second portion of said bushing extends upwardly above said bottom wall and into said exhaust passage.

4. In a marine drive having a driveshaft housing including a bell housing with an exhaust passage therethrough directing exhaust gas and cooling water, and a shift shaft extending axially generally vertically through said exhaust passage and journaled in said bell housing by a bushing in a generally vertical bore in a generally horizontal section of said bell housing, wherein said shaft rotates in said bushing about the vertical shaft axis and wherein said bushing is non-threadingly mounted in said bore, the interface of said bushing and said bore in said horizontal section of said bell housing being subject to corrosion from said exhaust gas and cooling water, said bushing comprising a first portion in said bore and having an outer diameter matching the diameter of said bore, said first portion of said bushing having an inner diameter greater than the diameter of said shift shaft and spaced radially outwardly therefrom to define an annular gap therebetween, said bushing comprising a second portion axially adjacent said first portion along the axis of said shift shaft and out of said bore, said second portion of said bushing having an inner diameter matching the diameter of said shift shaft and receiving and supporting said shift shaft for rotation therein, said annular gap enabling said first portion of said bushing to contract radially inwardly toward said shift shaft due to said corrosion at said interface, without binding said shift shaft and otherwise impeding rotation thereof, and wherein the interface of said second portion of said bushing and said shift shaft is exposed to said exhaust gas and cooling water in said exhaust passage.

5. A method for preventing binding of a shift shaft in a marine drive having a housing with an exhaust passage therethrough directing exhaust gas and cooling water, said shift shaft extending through said exhaust passage and journaled in said housing by a bushing in a bore in a section of said housing, a bearing surface being formed between said shift shaft and said bushing in said bore, wherein said shaft rotates in said bushing about the shaft axis and wherein said bushing is non-threadingly mounted in said bore, the interface of said bushing and said bore in said section of said housing being subject to corrosion from said exhaust gas and cooling water, which corrosion may force said bushing to contract radially inwardly toward said shift shaft at said bearing surface and bind said shift shaft and impede rotation thereof, said method comprising extending said bushing out of said bore in said section of said housing and providing a bearing surface between said shift shaft and said bushing which is out of said bore, and removing said bearing surface in said bore between said shift shaft and said bushing, and wherein the interface of said second portion of said bushing and said shift shaft is exposed to said exhaust gas and cooling water in said exhaust passage.

6. The invention according to claim 5 comprising extending said bushing into said exhaust passage such that said bearing surface out of said bore is in said exhaust passage.

* * * * *